US005458081A

United States Patent [19]

Reichert

[11] Patent Number: 5,458,081

[45] Date of Patent: Oct. 17, 1995

[54] ADJUSTABLE BOOKMARK

[76] Inventor: Susan A. Reichert, 572 Tea House La., Mt. Pleasant, S.C. 29464

[21] Appl. No.: 304,535

[22] Filed: Sep. 12, 1994

[51] Int. Cl.[6] ..... B42D 9/00

[52] U.S. Cl. ..... 116/234

[58] Field of Search ..... 116/234, 235, 116/238, 239, 240; 24/115 H, 129 D; 281/42

[56] References Cited

U.S. PATENT DOCUMENTS

| | | | |
|---|---|---|---|
| 1,455,879 | 5/1923 | Gronlund | 24/115 H |
| 1,999,583 | 4/1935 | Bouvier | 116/234 X |
| 3,397,026 | 8/1968 | Spina | 24/115.8 H |
| 3,425,389 | 2/1969 | Sacco . | |
| 3,670,691 | 6/1972 | Anderson | 281/42 X |
| 3,744,447 | 7/1973 | Hernon | 281/42 X |
| 3,898,951 | 8/1975 | Clare | D19/34 X |
| 4,041,892 | 8/1977 | Nichols . | |
| 4,487,156 | 12/1984 | Frost | 116/239 |
| 4,505,219 | 3/1985 | Mangano | 116/234 |
| 4,688,510 | 8/1987 | McNeely | 116/237 |
| 4,838,198 | 6/1989 | Knox | 116/239 |
| 4,932,351 | 6/1990 | Capamaggio | 116/237 |
| 5,022,343 | 6/1991 | Davis | 116/236 |
| 5,103,758 | 4/1992 | Clark | 116/237 |

*Primary Examiner*—Andres Kashnikow
*Assistant Examiner*—Willie Morris Worth

[57] ABSTRACT

A bookmark comprising of a folded cord member having two free ends, one to extend between the page to be marked, the other to extend between the front cover and the first page of the book. A size adjuster mounted toward the folded end of the cord member allows cords to be adjusted to fit the length of a book while anchors at the ends of the cord members keep the cord members from being pulled out of the book.

1 Claim, 1 Drawing Sheet

ADJUSTABLE BOOKMARK

BACKGROUND-FIELD OF INVENTION

Standard bookmarks have proven to be unsatisfactory since they utilize one flexible ribbon member easily misplaced or lost, and unavailable when needed. Spring wire used as a fastening member tends to tear, scrape or harm contacted surfaces upon insertion, withdrawal and repositioning of the bookmark. Fastening means attached to the pages of a book leave undesirable impressions on the contacted surfaces, particularly when objects are stacked on the marked books. Open-ended bent spring wire type fastening means are not durable and are easily bent out of shape, thereby losing their stability. Locating bookmarks while in use results in unnecessary and tedious search.

DRAWING FIGURES

SUMMARY OF INVENTION

Figure 1:
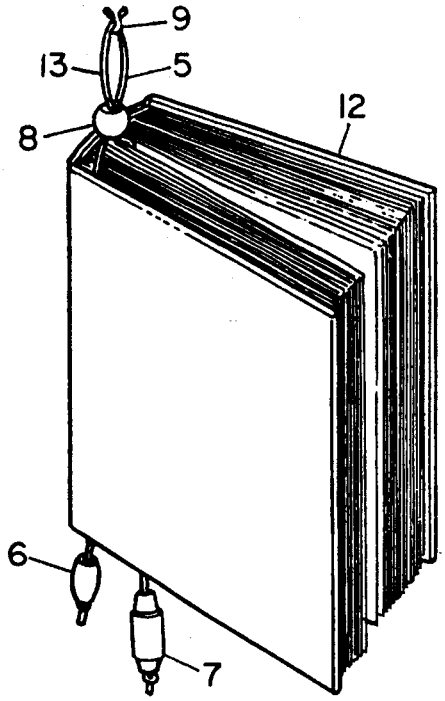
FIG. 1 is a perspective view of a book with an adjustable bookmark having its cord members inserted between book pages and the adjuster member slid down to anchor the bookmark in place.

An object of the invention is to provide a transferrable bookmark which never needs to leave the book.

Another object of the invention is to provide a bookmark which is unlikely to fall out of the book or become lost in the pages of a book.

Another object of the invention is to provide an adjustable bookmark for all size books.

The present invention contemplates a bookmark for books of all sizes having front and back covers. The book marker comprising one folded, long, thin, flexible cord-like member. One of the free ends of the folded cord member extends along the page to be marked, while the other free end of the folded cord member extends between the front cover and the first page of the book. An adjuster member is mounted toward the folded portion of the cord member and can be moved up or down the cords to adjust the length of the cords to fit any size book. Small anchor attachments are mounted to the two free ends of the bookmark in order to keep the cords from easily being pulled out of the book.

DRAWING REFERENCE NUMERALS 5 cord 6 small anchor 7 large anchor 8 size adjuster 9 stopper 10 double slip-knot size adjuster 11 single slip-knot size adjuster 12 book 13 adjustable bookmark

DESCRIPTION OF PREFERRED EMBODIMENTS

Figure 2:
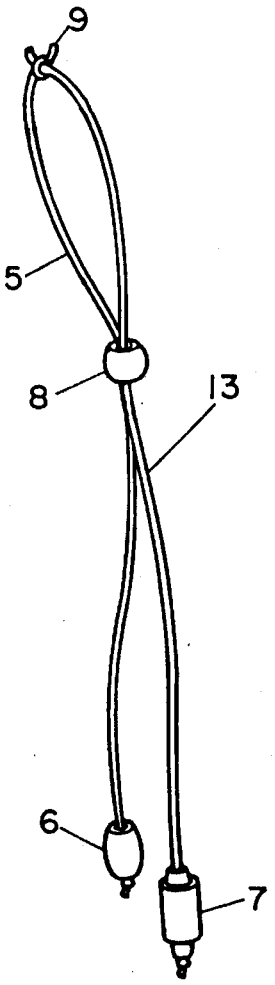
FIG. 2 is an elongated perspective view of the entire bookmark.

FIGS. 1–2 illustrates an adjustable bookmark 13 in book 12. Adjustable bookmark 13 comprising on one folded, elongated, flexible cord member 5, formed of any suitable string, ribbon or cord-like material including leather, plastic, nylon, polyester, satin, etc. The cord member 5 is knotted or ornamented at the folded end to act as a stopper 9 to keep the size adjuster 8 from sliding off the end of the folded cord 5. The size adjuster 8 consists of any small object or objects that can tightly bind the folded pieces of cord member 5 together but is loose enough to be moved up and down cord member 5 in order to make bookmark longer or shorter. This allows adjustable bookmark to fit any size book. Attached to one free end of the folded cord 5 is one or more small anchor attachment(s) 6 attached to the cord member 5 by any means. The small anchor 6 may be plain or decorative. A large anchor 7 with one or more plain or decorative anchors is attached by any means to the other free end of folded cord member 5. The large anchor 7 is larger to mark page, thus, making it easier to find a page in a book. Small anchor 6 and large anchor 7 are needed to keep cord member 5 from easily being pulled out from the pages of book 12.

Figure 3:
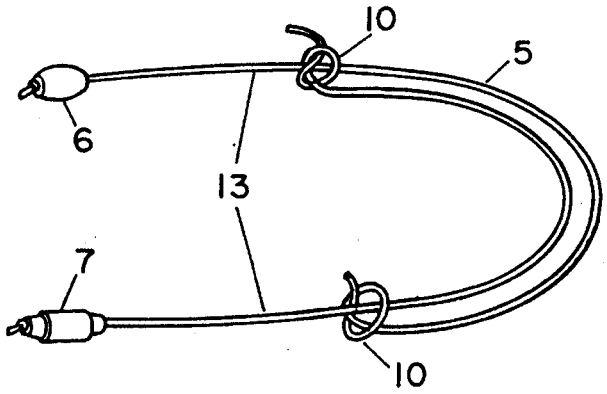
FIG. 3 is an elongated perspective view of a double slip-knot variation of the size adjuster member.
Figure 4:
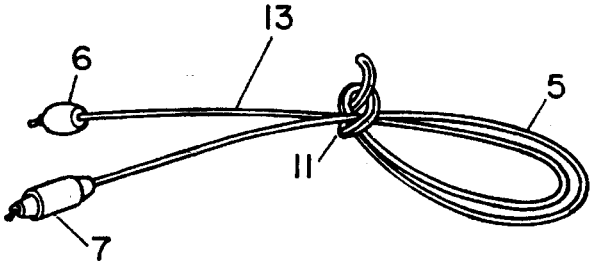
FIG. 4 is an elongated perspective view of a single slip-knot variation of the adjuster member.

FIGS. 3 and 4 show variations of size adjuster 8. FIG. 3 shows a double slip-knot size adjuster 10 which consists of two sliding knots that can be moved up and down cord member 5 in order to make the adjustable bookmark 13 longer or shorter. FIG. 4 shows a single slip-knot size adjuster 11 that can be moved up and down cord member 5 in order to make the adjustable bookmark 13.

I claim:

1. An adjustable bookmark to fit any size book that never needs to leave the book comprising:

a folded cord member with one closed end and two free ends, with one portion of said folded cord member extending between pages to be marked; a second portion of said folded cord member extends between a front cover and first page of a book never to leave this position until book is finished being read or used;

a size adjuster means mounted on the folded cord member toward the closed end of said folded cord member to be moved up and down along said folded cord mender to adjust the distance between the size adjuster means and the free ends of the folded cord member to fit any size book therebetween;

a stopper means mounted on the cord member towards the closed end of said folded cord member to keep said size adjuster means from sliding off the closed end of said folded cord member;

a small anchor member mounted to one of said two free ends of said folded cord member; and a larger anchor member mounted to a second of said two free ends of said folded cord member which is used to mark a page in the book.

* * * * *